US009569969B2

(12) United States Patent
Holihan et al.

(10) Patent No.: US 9,569,969 B2
(45) Date of Patent: Feb. 14, 2017

(54) TRACK COLLISION AVOIDANCE CONTROL SYSTEM

(71) Applicant: Raytheon Company, Waltham, MA (US)

(72) Inventors: Michael J. Holihan, Waltham, MA (US); Erwin W. Bathrick, Waltham, MA (US)

(73) Assignee: Raytheon Company, Waltham, MA (US)

( * ) Notice: Subject to any disclaimer, the term of this patent is extended or adjusted under 35 U.S.C. 154(b) by 65 days.

(21) Appl. No.: 14/255,770

(22) Filed: Apr. 17, 2014

(65) Prior Publication Data

US 2015/0302752 A1 Oct. 22, 2015

(51) Int. Cl.

| | |
|---|---|
| ***B61L 25/00*** | (2006.01) |
| ***G08G 1/16*** | (2006.01) |
| ***B61L 25/02*** | (2006.01) |
| ***B61L 23/22*** | (2006.01) |
| ***B61L 23/26*** | (2006.01) |
| ***B61L 15/00*** | (2006.01) |
| ***B61L 23/00*** | (2006.01) |

(52) U.S. Cl.

CPC ..... *G08G 1/164* (2013.01); *B61L 15/0027* (2013.01); *B61L 23/00* (2013.01); *B61L 23/22* (2013.01); *B61L 23/26* (2013.01); *B61L 25/02* (2013.01); *B61L 25/021* (2013.01); *B61L 25/023* (2013.01)

(58) Field of Classification Search

CPC ..... B61L 29/24; B61L 29/246; B61L 29/18; B61L 29/00; B61L 29/32; B61L 25/025; B61L 25/02; B61L 25/021; B61L 2205/04; B61L 1/188; B61L 27/0088; B61L 3/221

See application file for complete search history.

(56) References Cited

U.S. PATENT DOCUMENTS

| | | | | |
|---|---|---|---|---|
| 5,699,986 | A | 12/1997 | Welk | |
| 6,179,252 | B1 * | 1/2001 | Roop et al. | 246/293 |
| 7,196,636 | B2 * | 3/2007 | Graham | 340/933 |

(Continued)

OTHER PUBLICATIONS

Alibrahim; Signal and Train Control; Federal Railroad Administration Research & Development Program Review Power Point Brief; Nov. 2008; 18 pages; Federal Railroad Administration.

(Continued)

*Primary Examiner* — Jason C Smith

(57) ABSTRACT

A track collision avoidance control system including a train having an onboard control system for controlling one or more characteristics of the train. The track collision avoidance control system can further include a warning indication system comprising a transmitter linked to a communication system supported about the train, the communication system comprising a receiver operable to receive a signal from the transmitter, the signal comprising information pertaining to a potentially dangerous condition. The transmitter can be operable alone or in combination with a warning indicator, an actuator and their associated logic circuitry, such that the transmitter is caused to transmit upon the warning indicator being activated. The communication system can interface with an onboard control system of the train. The communication system can receive the signal, which can be used to facilitate an avoidance action to be taken relative to the train.

20 Claims, 4 Drawing Sheets

(56) References Cited

U.S. PATENT DOCUMENTS

| | | | | |
|---|---|---|---|---|
| 7,315,770 | B2 * | 1/2008 | Wade et al. | 701/19 |
| 7,769,544 | B2 * | 8/2010 | Blesener et al. | 701/301 |
| 7,772,996 | B2 * | 8/2010 | Burns | 340/991 |
| 8,297,558 | B2 * | 10/2012 | O'Dell et al. | 246/126 |
| 8,630,757 | B2 * | 1/2014 | Daum et al. | 701/19 |
| 8,838,301 | B2 * | 9/2014 | Makkinejad | 701/19 |
| 2011/0084176 | A1 * | 4/2011 | Reichelt et al. | 246/473.1 |
| 2011/0095139 | A1 * | 4/2011 | O'Dell | 246/293 |
| 2014/0012438 | A1 * | 1/2014 | Shoppa et al. | 701/19 |
| 2014/0263857 | A1 * | 9/2014 | Huntimer et al. | 246/122 R |

OTHER PUBLICATIONS

Arun et al.; Implementation of ZigBee Based Train Anti-Collision and Level Crossing Protection System for Indian Railways; International Journal of Latest Trends in Engineering and Technology; Jan. 2013; pp. 12-18; vol. 2, Issue 1; SSNG Education Society.

Federal Railroad Administration; Positive Train Control Implementation Status, Issues, and Impacts; Federal Railroad Administration Report to Congress; Aug. 2012; 50 pages; Federal Railroad Administration.

Peters et al.; Positive Train Control (PTC): Overview and Policy Issues; CRS Report for Congress; Jul. 30, 2012; 17 pages; Congressional Research Service.

TSE; Highlights of R&D Activities for PTC Implementation; Federal Railroad Administration Research and Development Program Review Power Point Brief; Mar. 12, 2009; 15 pages; Federal Railroad Administration.

* cited by examiner

TRACK COLLISION AVOIDANCE CONTROL SYSTEM

BACKGROUND

Railroad and train systems vary drastically in the speeds at which they operate, and the times and distances needed to stop. Additionally, as a result of terrain and space considerations trains often share tracks. In particular, for bi-directional shared lengths of track, electromechanical warning indication systems are located proximate track switches, which are utilized to provide a warning to trains approaching the switch that the upcoming track is presently occupied. These warning indication systems function similarly to a stoplight at a road intersection, wherein the indication system provides some indication that it is not presently safe to proceed. Typical warning indication systems utilize a visual stimulus, in the form of a red annunciator lamp, in order to signal to the train operator of the upcoming tracks status. The train operator is then relied upon to take appropriate action in order to bring the train to a stop prior to passing the annunciator lamp, thus averting a collision with a second train occupying the track ahead.

Unfortunately, many train collisions and derailments can be attributed to human error, namely an operator's failure to bring the train to a stop prior to passing the annunciator lamp. Such incidents are commonly referred to as run-through-red incidents. Run-through-red incidents can occur for a variety of reasons. In some example instances, the operator cannot be paying adequate attention, or can otherwise be incapacitated and either does not notice the warning in time, ignores the warning, or has become unable to take appropriate action in response to the warning.

The warning indication systems and the annunciator lamps rarely fail, as they often rely on a variety of sensors which indicate the presence of a train on a particular length of track. Additionally, these warning indication systems have various backup systems which account for power outages, sensor failures, or burnt out bulbs. These various safeguards ensure that at least some indicia regarding the warning is provided to the train operator. As such, collisions which occur on trains are typically caused by human failure in recognizing the warning and taking appropriate action to bring the train to a stop, and are not due to failure of the present warning indication systems.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention, they are, therefore, not to be considered limiting of its scope. It will be readily appreciated that the components of the present invention, as generally described and illustrated in the figures herein, can be arranged and designed in a wide variety of different configurations. Nonetheless, the invention will be described and explained with additional specificity and detail through the use of the accompanying drawings in which:

DETAILED DESCRIPTION

Figure 1:
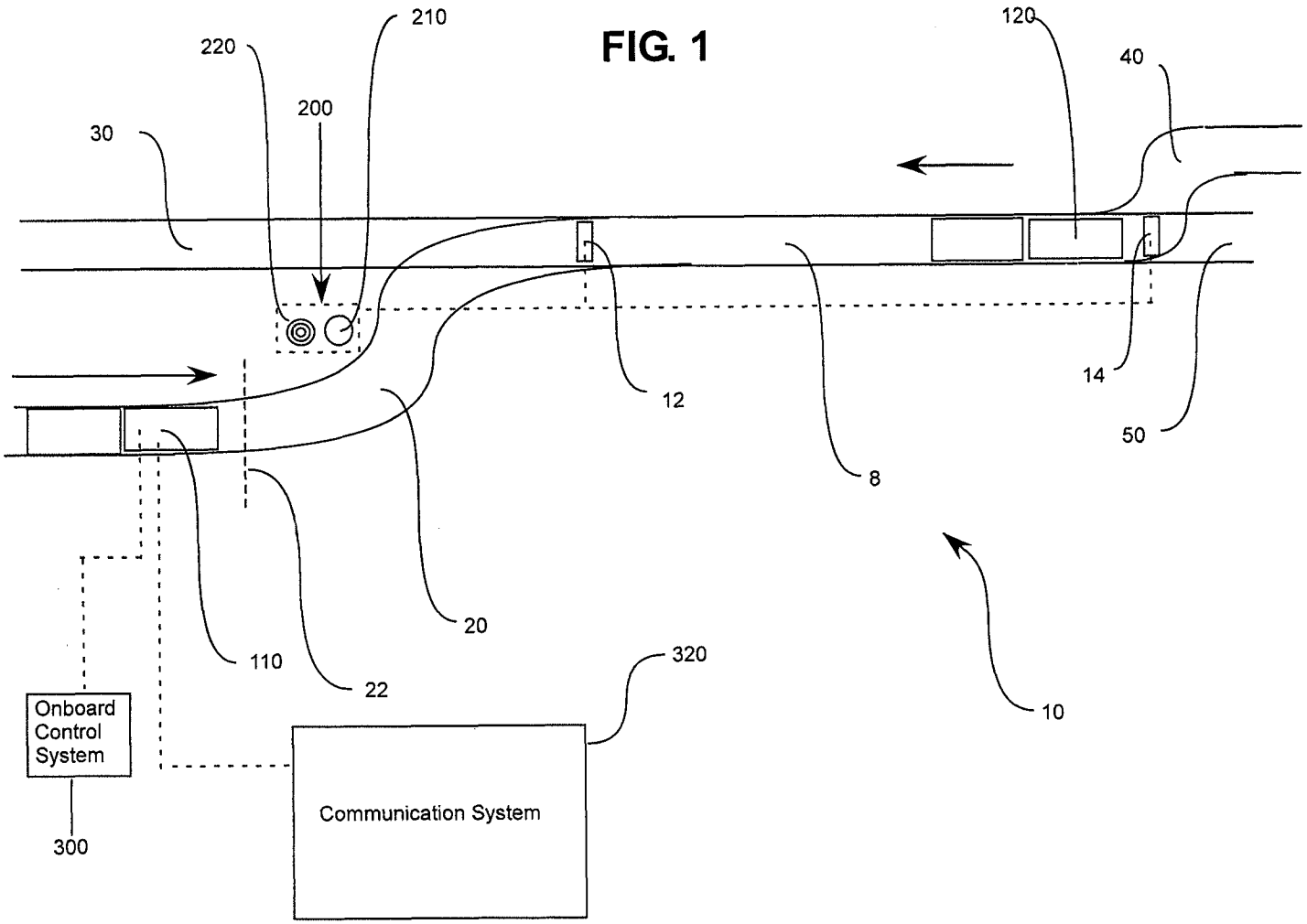
FIG. 1 illustrates an exemplary schematic of a section of railroad track having a switch with a section of shared track and an exemplary track collision avoidance control system.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

It has been recognized that present warning indication systems do not provide adequate protection to trains for the purpose of avoiding collisions. Present systems rely on line of sight, wherein the train operator is required to visually recognize a distant warning indicator (e.g., a red stop lamp) and take action in a sufficient amount of time so as to bring the train to a stop before reaching the warning indicator. As discussed above, any failure by the operator to take appropriate action can result in a collision, derailment, or other catastrophe. As such, example embodiments of the present invention seek to account for those situations where the operator is unable to, or fails to, recognize the warning indicator and/or to take appropriate action.

Other proposed solutions to train collisions involve the use of satellite and terrestrial communication links, complex control systems connected through fiber optic, microwave, and computer-aided dispatching and back office server systems, which solutions can commonly be referred to herein as positive train control. These systems involve the simultaneous tracking and computer control of all trains located on a particular track or in a particular region. Such positive train control systems have proven to be extremely expensive, burdensome to implement, and have multiple points of possible system failures or can be vulnerable to hostile attack. Many railroad companies and train owners, particularly small regional railroads, find it very difficult to implement such new train safety systems.

It has therefore been recognized that a low cost alternative to positive train control would be beneficial, particularly if such an alternative were able to leverage currently employed rail infrastructure, such as current warning indication systems (e.g., stop lamp logic) in order to protect individual trains and sections of track, and to avoid run-through-red incidents. Utilizing rail infrastructure already in place can offer increased safety at a greatly reduced cost as compared with other solutions, such as positive train control solutions.

It has further been recognized that some form of automatic train control can be provided in order to minimize or eliminate human error, and the potentially catastrophic consequences resulting from the failure/inability to recognize an indicated warning and the failure/inability to take appropriate action.

In general, the present disclosure relates to a track collision avoidance control system which can include and leverage presently existing systems about the track, such as stop lamps (or other annunciators), switches or electro-mechanical systems that control and activate these, etc. The track collision avoidance control system can further comprise a warning indication system having a transmitter, either stand-alone, or operable with an existing warning indication system having a warning indicator and an actuator to actuate the warning indicator. The transmitter can comprise a radio link, such as an RF or other type of transmitter capable of emitting a signal containing usable information pertaining to a potentially dangerous condition. Further, the transmitter can be operable with sensors located about the track in order to determine the existence of a potentially dangerous situation. An approaching or oncoming train (or other type of vehicle) (i.e., a train approaching a potentially dangerous condition or situation) can comprise and have supported thereon a communication system having an embedded receiver operable to receive the signal produced by the transmitter. As the oncoming train travels within an unsafe distance of the potentially dangerous situation, the communication system can be configured to communicate the existence of the potentially dangerous situation, either to the operator and/or the train's onboard control system, thereby facilitating a collision avoidance action to be taken relative to the train based on the information. In some embodiments, the circuitry and source which powers the warning annunciator lamp can also be configured to power and energize or otherwise activate the transmitter, and a resultant encoded signal representing the state of the track can be transmitted to the receiver of the communication system located on the oncoming train. The signal received can comprise different types of useful information pertaining to the potentially dangerous situation, such as information that can be utilized to determine the existence and location of a potentially dangerous situation and proximity of the train to such location. The information can then be received by the communication system onboard the oncoming train which can then signal an audible or visible alert to the train operator, or that can provide one or more signals or commands to the onboard control system of the train, so that an appropriate collision avoidance action is taken either by the train operator or the onboard control system. An avoidance action can comprise various types, such as an operator slowing or stopping the train, or more disruptive actions, such as the communication system automatically initiating an avoidance action through the train's onboard control system.

In some embodiments, the avoidance action can be performed by the train operator. In other aspects, the avoidance action can be performed automatically by the communication system initiating an action through an interface with the train's onboard control system. In still other aspects, a hierarchy of collision avoidance actions can be implemented by either the train operator or the onboard control system or both. For example, a primary collision avoidance action can be the train operator responding to an indication notifying him/her of the dangerous situation. The train operator can then perform an appropriate action, such as slowing or manually stopping the train. In the event the train operator does not take any action, a secondary collision avoidance action can be that the communication system causes or initiates an automatic avoidance action via the train's onboard control system, which can be configure to control various functions of the train, such as throttle, braking, etc. This secondary avoidance action can be initiated, for example, if the train proximity to the dangerous situation exceeds a proximity threshold. The automatic avoidance action can comprise a hard stop or shutdown of the train absent operator action, thus removing the necessity of a human response.

In any event, the track collision avoidance control system can be designed to initiate an avoidance action about the train well in time for the train to stop (or take other corrective action) before reaching a location of the potentially dangerous condition.

With reference to FIG. 1, illustrated is an example section of track including a potentially hazardous condition wherein two trains can possibly interfere or collide with one another on a bi-directional section of a single track. The track can include a bi-directional track section 8, as well as various other sections of track, namely track sections 20, 30, 40, and 50, each of which can converge into the bi-directional track section 8. The bi-directional track section 8 can serve one or more functions. However, in the present example, this section of track can be configured to function as a transfer line that facilitates the transfer of trains from one track to another. For example, train 120 can be caused to move from track section 40 to track section 30 via bi-directional track section 8. Alternatively, the bi-directional track section 8 can be located in an area (e.g., a rural or non-populated area) where a single track can be employed to service multiple trains, these trains coordinating the shared use of the single bi-directional track section 8. In any event, it is to be understood that the bi-directional track section 8 presents a situation where two trains can potentially occupy the bi-directional track section 8 at the same time, thus creating a potentially dangerous situation where the two trains may collide. Indeed, in such a condition, a collision can be more likely if an oncoming train (e.g., see train 110), is unaware that the bi-directional track section 8 is presently occupied.

It should be appreciated that while the present invention will be discussed primarily with regard to the example involving a single bi-directional track section, that this is not intended to be limiting in any way. Indeed, it is contemplated that the various systems and methods discussed herein are applicable to other track sections and to other types of dangerous conditions involving one or more trains, or even potentially dangerous sections of track. For example, the various systems and methods discussed herein can be deployed at other sections of track where other types of dangerous conditions or situations potentially exist. One example of another such type of potentially dangerous condition can be a sharp turn that presents derailment dangers for a train travelling at excessive speeds. Some of these alternative situations are discussed in more detail below, but in no way represent the only possible situations. Indeed, those skilled in the art will recognize the variety of potentially hazardous situations in which the systems and methods discussed herein can be utilized.

For exemplary purposes, the scenario illustrated or depicted in FIG. 1 will be discussed in detail. In this exemplary scenario an oncoming first train 110 is travelling along a track section 20 with the intent to enter the bi-directional track section 8. Also shown is a second train 120 presently occupying the bi-directional track section 8 as it is switching from track section 40 to track section 30 via the bi-directional track section 8. In this scenario, a potentially dangerous situation (e.g., a potential collision) is made possible in the event the first train 110 were to continue and enter bi-directional track section 8 before the second train 120 were to exit the bi-directional track section 8. The illustrated scenario represents an exemplary type of situation the present disclosure seeks to protect against and avoid altogether.

Presently, there exists current rail infrastructure that provides a measure of safety to trains, and that is intended to be used by the systems and methods discussed herein. In some examples, the rail infrastructure can comprise various warning indication systems that comprise various warning indicators (e.g., stop or annunciator lamps) operable with various actuators, such as switches (or other electro-mechanical actuators). The warning indication systems can be located about sections of track, and actuated (e.g., switched) by a passing train. One non-limiting example of a warning indication system is an electro-mechanical type warning indication system (i.e., actuators, such as switches, that are electrically coupled to and in communication with a warning indicator) operable about a section of track that functions to indicate some type of condition or situation present on a train track, such as an intersection, etc. Warning indicators can comprise audio indicators (e.g., horns) or various visual indicators (e.g., annunciator or stop lamps). Despite these existing capabilities, present warning systems are flawed in at least two ways in that 1) they rely on the operator of a train to recognize and visually identify that the annunciator lamp is illuminated, and 2) they require the operator to take appropriate actions, such as to bring the train to a stop to avoid a dangerous situation.

In some example embodiments, the present disclosure seeks to utilize such existing infrastructure and safeguards and enhance their usefulness and capabilities by incorporating these into a track collision avoidance control system operable to provide early warning to train operators, via a communication system on the train, of potentially dangerous conditions. The communication system on the train can be configured to receive a signal transmitted by a transmitter, which signal contains information pertaining to the potentially dangerous condition. In some embodiments, the transmitter can be a stand-alone warning indication system receiving power from a proprietary source. In other embodiments, the transmitter can be operable with an existing warning indication system having a warning indicator activated by an actuator, such that when the warning indicator is activated, the transmitter is also activated and caused to transmit a signal. In still other embodiments, the communication system of the track collision avoidance control system can further comprise or interface with a train's onboard control systems, wherein the communication system operates to communicate with the onboard control system to automatically initiate one or more disruptive commands to carry out one or more avoidance actions.

FIG. 1 illustrates a track collision avoidance control system 10 in accordance with one example. The track collision avoidance control system 10 can comprise a warning indication system 200 comprised of existing rail infrastructure. In one exemplary embodiment, the warning indication system 200 can comprise a warning indicator in the form of an annunciator or stop lamp 210. Of course, other types of warning indicators are contemplated herein. The warning indication system 200 can further comprise one or more sensors in electrical communication with the annunciator lamp 210, such as via hard-wired circuitry. In the present exemplary embodiment, the annunciator lamp 210 can be operable or in communication with sensors in the form of switches 12 and 14 supported about a bi-directional track section 8. The annunciator lamp 210 can be activated by a train 120 passing over and triggering switch 14 as the train passes onto bi-directional track section 8, wherein the annunciator lamp signals the presence of the train 120 on a section of track potentially accessible by other sections of track and other oncoming trains (thus defining a potentially dangerous condition about bi-directional track section 8). The annunciator lamp 210 can be deactivated when the train 120 passes over and triggers switch 12, such as when it passes off the bi-directional track section 8 (thus providing a safe or an all clear situation about bi-directional track section 8). Such sensors/switches 12 and 14 are often placed at junctions, wherein stop lamp logic is utilized to determine the presence of a train on the appropriate section of track.

It is noted that the annunciator lamp 210, as part of the track collision avoidance control system 10, can function as intended with the present disclosure, as well as in the same manner as originally intended or in other words as prior annunciator lamps, namely to provide a line of sight or visual warning to approaching trains when an upcoming track section beyond the annunciator lamp 210 is occupied.

Several different types of fail-safe technologies operable about the rail can be implemented with the track collision avoidance control system 10, to cause the warning indication system 200 to activate the annunciator lamp 210. Such technologies can include proximity sensors, weight/pressure sensors, switches and associated logic as discussed above, infrared sensors, laser sensors, or any other type of sensor that can sense and indicate the presence of a train on a section of track, such as bi-directional track section 8, and cause the annunciator lamp 210 to be activated. It should be appreciated that warning indication system 200 can employ any such technology in any number and combination, such that activation of annunciator lamp 210 is ensured when bi-directional track section 8 is occupied. As such, and as discussed herein, failure of the warning indication system 200 to cause annunciator lamp 210 to illuminate is rarely a cause of collision.

The track collision avoidance control system 10 can further comprise a transmitter 220 (which may be referred to herein as a railway sensor in some embodiments) located about a track section that is operable to transmit a signal to the oncoming train 110, the signal containing information about the potentially dangerous condition about bi-directional track section 8. The transmitter 220, in some examples, can be powered by a proprietary power source. In other examples, the transmitter 220 can be integrated into and powered by an existing warning indication system 200 using existing rail circuitry (e.g., existing stop lamp circuitry), such that the transmitter 220 is caused to activate when the annunciator lamp is activated. Stated differently, in one example embodiment, the track collision avoidance control system 10 can comprise a warning indication system 200 that is made up of or that comprises just the transmitter 220, in which case the transmitter can be operable with a railway sensor operable about a track section and configured to facilitate activation of the transmitter 220. In another example embodiment, the warning indication system 200 can comprise the transmitter 220, as well as an existing warning indicator and actuator (and their associated logic circuitry), wherein the transmitter 220 is integrated into the logic circuitry of the warning indicator and the actuator, and wherein the warning indicator is operable with a railway sensor operable about a section of track that is configured to facilitate activation of both the warning indicator and the transmitter.

The signal transmitted by the transmitter 220 can comprise information, such as a status of the annunciator lamp 210, the location of the annunciator lamp 210 and/or the transmitter 220, and other information pertaining to the potentially dangerous condition about the bi-directional track section 8. The signal transmitted by the transmitter 220 can be received by a receiver 322 located on the oncoming train 110, as will be discussed in greater detail below.

One type of transmitter 220 contemplated for use is a secondary transceiver interfacing to a cellular device, wherein the cellular device is active within a cellular network. An example of the secondary transceiver is an RF transceiver integrated circuit with a configurable baseband modem that communicates with a cellular device. The transceiver's transmitter broadcasts a digitally modulated radio frequency signal with data. The transmit frequency can be selected to operate in licensed (near 220 MHz for US Class I freights, most small freight railroads, and other commuter railroads) or unlicensed bands (ISM radio bands) or as determined by the train operator. The secondary transceiver can be integrated into a single assembly with the cellular device as part of a new annunciator lamp or a separate enclosed system with wireless or wired connectivity to the cellular device.

The signal transmitted by the transmitter 220 can include information pertaining to the annunciator lamp itself, the transmitter itself, the track section about which it resides, the train, and any combination of these. For example, the transmitted signal can include information regarding a physical address or location of the annunciator lamp 210, a status of the annunciator lamp 210 (i.e., such as whether the annunciator lamp 210 is active, inactive, or in a failure condition), a physical address or location of the transmitter 220, and other information pertaining to the dangerous condition. The annunciator lamp status can be determined by measuring current drawn by the lamp, detecting light from the lamp, or other methods. In the embodiments where the transmitter 220 is not integrated into an existing warning indication system, the transmitted signal can comprise information about the transmitter 220 and other information pertaining to the dangerous condition. In the embodiment shown, the signal provides information pertaining to the warning indication system 200 and the bi-directional track section 8. The transmitter 220 can be provided in a variety of configurations, as will be discussed in more detail below.

It should be appreciated that the transmitter 220 can act as a beacon. In one aspect, the transmitter 220 can be configured to continuously transmit the signal. Alternatively, the transmitter 220 can be configured to periodically transmit the signal, such as when the bi-directional track section 8 is occupied and a warning indication system is activated (in the embodiment where the transmitter is integrated into the warning indication system), or when the transmitter 220 is activated by a passing train (in the embodiment where the transmitter is a stand-alone device). In either case, transmission of the signal is indicative that the bi-directional track section 8 is occupied and that some action needs to be taken by the oncoming train 110 to avoid or mitigate the potentially dangerous condition.

In some situations, to avoid the dangerous condition, the action that may need to be taken is to cause the oncoming train 110 to come to a stop prior to entering the bi-directional track section 8. However, great distances are often required for a train to come to a complete stop. For example, while some commuter type trains can stop relatively quickly (e.g., within several hundred yards), some freight or other trains can take two or more miles to come to a complete stop. As such, the transmitter 220 can be configured to comprise a suitable power level, such that the signal from the transmitter 220 is receivable by the receiver 322 on the oncoming train 110 up to several miles away and through various objects or obstacles or structures. In one embodiment, the transmitter 220 can be configured to transmit a signal up to four miles away to allow trains ample time to come to a stop prior to encountering the potentially dangerous situation. Transmission power and spectrum utilization is often limited by regulatory authority. For example, under the United States FCC rules, a maximum of 27 dBm of power into a 9 dBi omnidirectional antenna (4 W EIRP or 36 dBm), or 24 dBm of power into a 24 dBi directional antenna for point-to-point links (48 dBm or 16W EIRP) is permitted. Under common European rules (i.e. ETSI), the maximum effective radiated power (transmission power plus antenna gain) is 100 mW EIRP (20 dBm). In one aspect, the transmission power level can be set to the maximum allowed 48 dBm for a point-to-point link between the transmitter and the train communication system. The path loss (L) is equal to 36.6 dB+20×log(D)+20*log(F) where D is in miles and F is in MHz (10^6 Hz). Using this formula, the path loss for a distance of four 4 miles is −116 dB for a transmit frequency of 2.4 GHz (as an example transmit frequency). A maximum 48 dBm EIRP is received at a power level of −68 dBm for a direct line of sight signal reception for this distance, above a typical −80 dBm minimum sensitivity of typical receivers. In cases of signal path obstructions, signal repeaters can be used along the path between the oncoming train and the potentially dangerous situation so as to ensure adequate received signal levels.

In addition, the transmitter 220 can be configured to transmit the signal on a frequency also suitable to be received by the receiver 322 on the oncoming train 110 up to several miles away and through various objects or obstacles or structures. As noted above, the transmit frequency can be selected to operate in licensed (near 220 MHz for US Class I freights, most small freight railroads, and other commuter railroads) or unlicensed bands (ISM radio bands) or as determined by the train operator.

For purposes of the present disclosure, any number of types of transmitters can be utilized, including radio links, satellite links, laser and infrared emitters, iridium links, or any other device or system as will be recognized by those skilled in the art. In some embodiments, high-powered, low-frequency VHF bands can be used, which can comprise good signal strength at the desired distances, while also being able to penetrate obstacles that can reside between the train 110 and the transmitter 220. Such obstacles can vary in scope from large buildings to canyon walls, etc. In addition, frequencies ranging from 300-400 MHz have proven to be of some advantage for penetrating these types of obstacles and maintaining a signal strength sufficient for receipt by the receiver at distances up to 4-5 miles.

Figure 2:
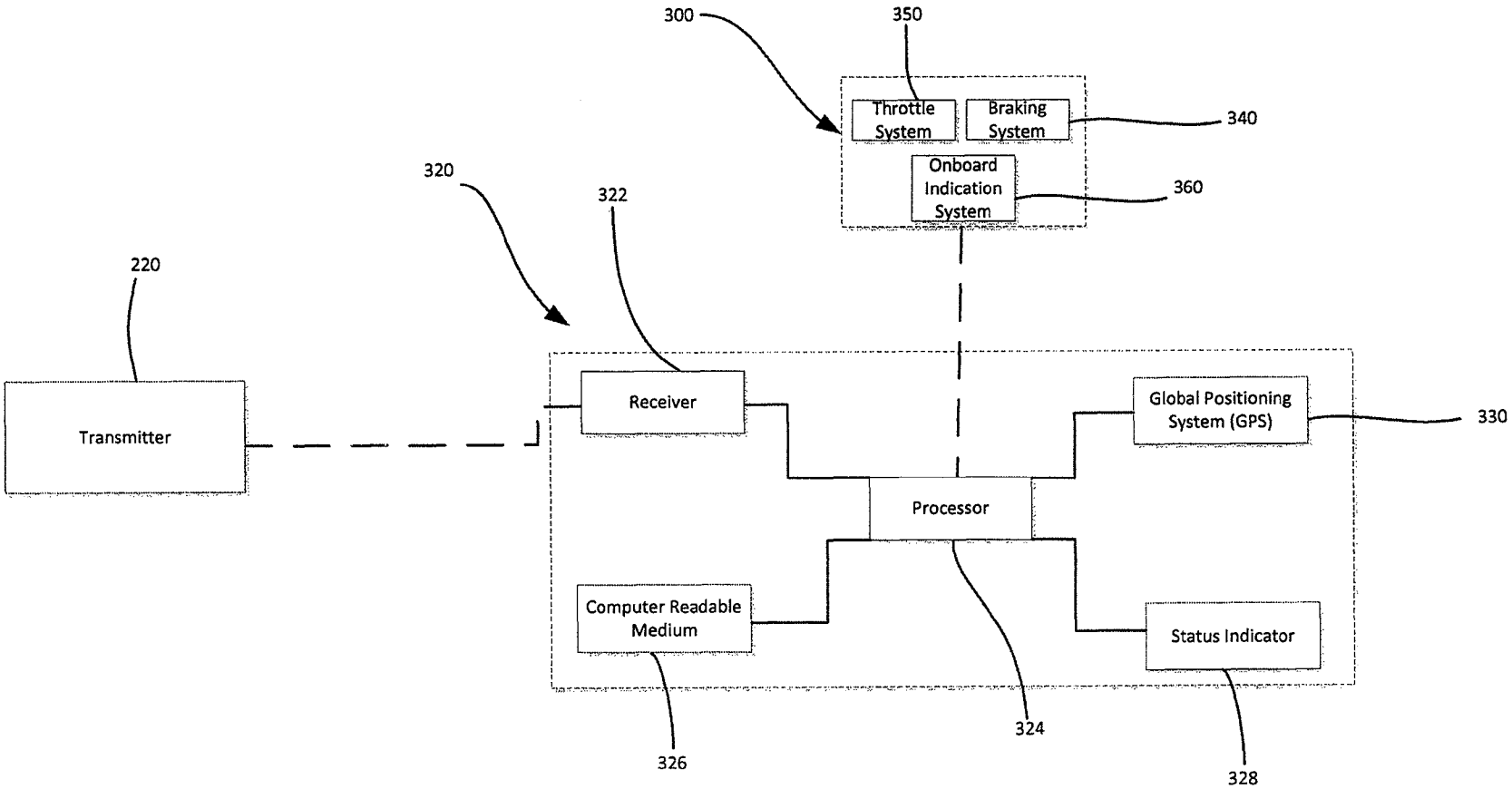
FIG. 2 illustrates an exemplary schematic of a train collision avoidance control system.

With reference to FIGS. 1 and 2, the track collision avoidance control system 10 can further comprise, a communication system 320 located on and operable with or about the oncoming train 110, the communication system 320 comprising the receiver 322. In some aspects, the communication system can be configured to interface with an onboard control system 300 located on the train 110. The onboard control system 300 can be caused to perform a disruptive avoidance action as initiated by the communication system 320 by way of a disruptive command generated in response to the signal (and the information therein) received from the transmitter 220. In one embodiment, a disruptive avoidance action can be initiated from a disruptive "shut down" command that causes the train to come to a stop prior to passing the annunciator lamp 210 and reaching the bi-directional track section 8. In some examples, the communication system 320 can cause the onboard control system 300 to initiate a disruptive avoidance action automatically, without requiring recognition or action by the train operator.

The communication system 320 can further comprise a receiver 322 operable to receive the signal from the transmitter 220, which signal can be encrypted as needed or desired. The receiver 322 can be powered by a proprietary power source (e.g., a battery) or it can be electrically coupled to the train's onboard power source and powered by the train. In some embodiments, the receiver 322 can comprise both, with the batteries providing a back-up power source. The communication system 320, and particularly the receiver 322, can receive the signal from the transmitter, such that the signal essentially "handshakes" with the receiver 322. Once this "handshake" is achieved, the signal can continuously update to the receiver 322 to accurately monitor the distance between the location of the transmitter 220 (and/or the annunciator lamp 210) and the oncoming train 110. Upon reaching a pre-determined distance, the receiver 322 can annunciate the appropriate information and the communication system 320 can potentially initiate a soft or hard train shutdown, thus removing the human element response from a potentially disastrous outcome.

One exemplary type of receiver, being part of the communication system, is a secondary transceiver paired with the transmitter 220 and interfacing to a cellular device having GPS for determining the position of the oncoming train, wherein the cellular device is active within a cellular network. The transceiver can receive RF signals from the transmitter 220 and can decode the digital information from the transmitter in order determine a best course of action based on further processing. The receiver 322 can be integrated into a single assembly with the cellular device as part of a new or existing computer, touch screen device, or other input/output device.

The communication system 320 can further comprise one or more indicators 328 configured to convey or present the information received from the transmitter 220 and/or processed by the communication system 320, or pertaining to the train, to the train operator. Thus, the oncoming train 110 can be referred to as a "smart" train as it is configured to receive, process and present information pertaining to the potentially dangerous condition, which will likely be out of sight of the train operator at the time presented. The communication system 320 can still further comprise a processor 324, a hard-drive or other computer readable memory medium 326, and other computer logic or circuitry or processing capabilities that enable the communication system 320 to receive and process the signal(s) as transmitted by the transmitter 220 to determine and identify a potentially dangerous condition ahead, as well as to determine what collision avoidance actions may need to be taken.

In one aspect of the present invention, the communication system 320 can further comprise, or be otherwise operable with, a global positioning system (GPS) 330. The GPS 330 can be configured to provide information regarding the physical location or position of the train 110, as well as information derived from the position and movements of the train, such as speed and direction of travel. In addition, the communication system 320 can be configured to receive and process any position or other information that may be in the transmitted signal as received from the transmitter 220, such as the physical location of the transmitter 220, position and status of a warning indicator, the location of the potentially dangerous situation, etc. (for example the occupied bi-directional track section 8, which is proximate the annunciator lamp 210 and the transmitter 220). The processor 324 of the communication system 320 can then be in possession of real-time information regarding the potentially dangerous condition. Furthermore, the communication system can be in possession of information regarding the train 110 itself, such as position, and movement information as received from the GPS 330. With the real-time information regarding the train and the potentially dangerous situation, a distance between the train and the location of the potentially dangerous condition can be determined. A time of approach, as well as necessary suggested avoidance actions that can be taken to avoid the potentially dangerous condition may also be determined. With this kind of information known, the best collision avoidance actions can be more readily ascertained in order to the potentially dangerous condition.

One collision avoidance action can simply be the operator responding to an indication of the potentially dangerous situation. Indeed, the communication system (or the onboard control system) can be configured to merely provide some sort of an indication to the operator of the train 110 that a dangerous or potentially dangerous condition is ahead, thus signaling that the operator needs to start taking appropriate measures in order to mitigate the danger, such as to slow or stop the train 110 prior to reaching the location of the dangerous condition. Such an indication can be as simple as providing some audio or visual indicia to warn the operator of the condition. In some embodiments, the indication can correspond to a status of a warning indicator, or a proximity of the train to the warning indicator, etc. Upon being warned, the operator can take the necessary action.

In some embodiments, the communication system 320 can further comprise some type of operator interface, such as a display or other onboard indication system 360. The operator interface can further be configured to provide audio and/or visual indicators representative of the information discussed herein, such as that corresponding to the information in the received transmitted signal, or that of the communication system (e.g., GPS information), or that of the train, or a combination of these. For example, the display can communicate a position of the transmitter 220, a determined distance of the train from the transmitter 220 and/or the annunciator lamp 210, a speed of the train 110, an estimated time of passing, a suggested or recommended course of action, or any other information which can be useful to the operator in deciding a best course of action to be taken.

As indicated, the communication system 320 can further be configured to communicate or interface with an onboard control system 300 of the train. In the event the train operator cannot or does not take any action in response to the warning, the communication system 320, as operable with the onboard control system 300, can optionally carry out an automatic avoidance action in order to avoid the recognized dangerous situation. In other words, the communication system 320 can be configured to interface with an onboard control system 300 of the train 110, such that the communication system 320 further functions to initiate one or more disruptive commands to cause the onboard control system 300 to carry out one or more disruptive avoidance actions. The onboard control system 300 can be in mechanical or electrical communication with the throttle systems 350 and/or braking systems 340 of the train 110. In such instances, advanced controls and actuators capable of controlling one or more train functions (e.g., reducing throttle, applying a braking system, actuating other systems otherwise capable stopping the train, or other types of train functions), can be provided by the onboard control system 300. Upon identification of an upcoming dangerous condition, such as can be determined by processing the signal received from the transmitter 220, the communication system 320 can interface with the onboard control system 300 to initiate a disruptive command, thus slowing or bringing the train to a stop.

In order to determine the appropriate avoidance action to be taken, the onboard control system 300 can include a processor 330, a hard-drive or other computer readable medium 326, and associated computer circuitry capable of using information about the train (e.g., weight, stopping power, etc.), as well as information regarding motion characteristics of the train (e.g., speed, direction, etc.) in order to determine when the train needs to begin stopping in order to stop before reaching the location of the dangerous condition (and, in some cases, the illuminated annunciator lamp 210). Such predetermined disruptive commands can include applying the brakes, or reducing the throttle, or both, in order to ensure that the train does not reach the location of the dangerous condition (and, in some cases, run through the annunciator lamp 210) absent any action by the train operator. In this manner, if the operator is incapacitated, distracted, or physically unable to take any avoidance action (i.e., the operator does not respond to the warning indicated), the train's controls can be disrupted or taken over by the track collision avoidance control system 10.

The latest point at which the train needs to begin stopping in order to be able to stop before reaching the location of the potentially dangerous condition can be referred to herein as the proximity threshold 22. In this case, the proximity threshold 22 represents the minimum distance from the bi-directional track section 8 in which some action must be taken in order to avoid a potential collision with the train already occupying this section of track. Upon reaching the proximity threshold 22, the communication system 320 can automatically begin stopping the train 110 by initiating one of many predetermined disruptive commands. It will be appreciated that in the event the transmitter 220 is located about an alternative location, such as a sharply curved section of track, the predetermined set of disruptive commands for such a location may not require the train to come to a complete stop, but only be throttled back to a reduced speed commensurate with safely traveling through the curved section of track. In this manner, various predetermined disruptive commands can be customized for various locations, and for this reason it can be advantageous for each location to comprise a specific identify and to be able to be specifically identified. This individual location and identity information can be used in determining an appropriate and corresponding avoidance action to be taken.

It will further be appreciated by those skilled in the art that the various avoidance actions discussed herein can be carried out as needed or desired, (such as in any order, or in any combination). Additionally, certain throttling and braking sequences can be provided by a given type of train so as to avoid causing damage to the train's working mechanisms or systems (e.g., the engine or brakes). Such sequences can be incorporated or programmed into the communication system 320, or otherwise communicated to the communication system 320.

It will still further be appreciated that the communication system 320 can include computer circuitry to connect the processor 324, and the computer readable medium 326, i.e. a hard-drive. The processor 324 can be configured to process the information from systems such as the GPS 330, the transmitter 220, the communication system 320, etc., and then access the predetermined sets of instructions stored on the computer readable medium 326. Using various algorithms, the processor 324 can then determine which set of predetermined avoidances actions are appropriate for a given situation, the communication system 320 initiating these, to avoid the potentially dangerous condition which can be caused by a run-through-red situation.

Figure 3B:
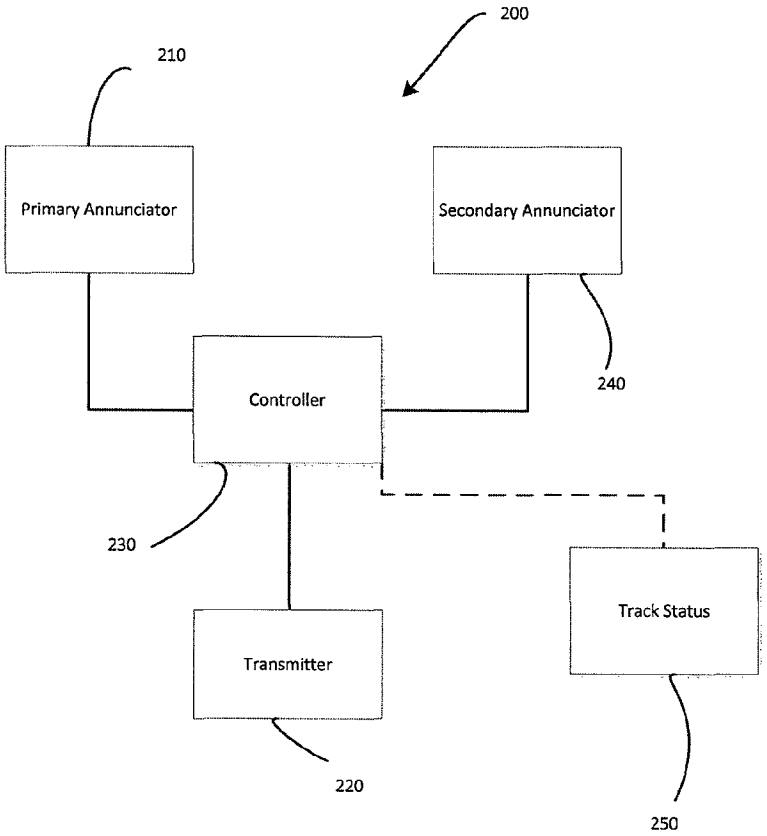
FIGS. 3A-3B illustrate block diagrams of various components in an exemplary warning indication system as part of an exemplary train collision avoidance control system.
Figure 3A:
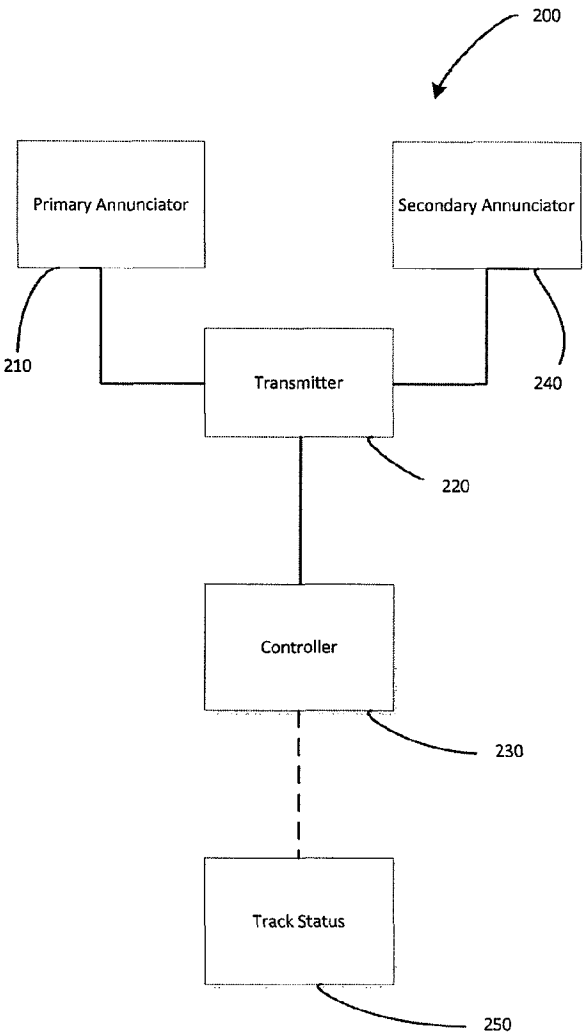

FIG. 3A-B depicts exemplary orientations how a transmitter can be integrated into presently existing warning indication systems. These systems typically have a controller 230 which receives a signal regarding track status 250 from the various sensors discussed above supported about the track. The controller 230 typically determines the presence of a potentially dangerous situation and then illuminates an indicator, i.e. a primary annunciator lamp 210. In the event of a failure of the primary annunciator lamp 210 the controller can also typically illuminate a secondary or backup annunciator lamp.

FIG. 3A depicts one exemplary way in which the transmitter 220 can be integrated into a warning indication system 220. As shown, the transmitter 220 can be wired into the existing circuitry of the warning indication system 200. In this example the transmitter 220 is provided inline with the power line to each of the annunciators. In this way activating or energizing the annunciator lamps 210 or 240 also causes the transmitter 220 to become energized and to begin transmitting a signal. It is appreciated that turning on the transmitter with both the primary and secondary annunciator lamps provides a degree of redundancy in the event the primary annunciator lamp 210 is burned out or otherwise not functional.

With reference to FIG. 3B, the transmitter 220 can be independently wired into the circuitry of the warning indication system 200. In this manner, transmitter 220 can be electrically connected to the controller 230, such that the transmitter 220 can be activated upon the controller 230 receiving a signal regarding the track status 250 and a command to activate the annunciator lamp 210. In this way, the energizing of the transmitter 220 is not dependent on the energizing of any indicators, but is activated when the controller determines that a potentially dangerous condition exists, i.e. when a signal regarding the track status 250 is fed to the controller 230. In this manner, energizing of the transmitter does not depend on whether the primary annunciator 210 or the secondary annunciator 240 is energized. Energizing of the transmitter in this case would occur even if bot annunciator lamps had failed, or alternatively if a different types of indicators were employed.

Alternatively, the transmitter 220 can be hardwired into the power source (not shown) of the warning indication system 200, the transmitter 220 being configured to broadcast/transmit the signal continuously. In this situation the transmitter 220 can broadcast the signal at all times regardless of whether any indicator within the indication system 200 is energized or whether or not a dangerous situation exists. In this example, some sort of signal is being continuously broadcast. However, it is appreciated that for a continuously broadcast signal, the information contained in the signal can be configured to change based on the status of the warning indicator. For example, when no dangerous situation exists ahead, the signal can contain such status information reflecting, which can be received by the communication system on board the train and a status of all-clear can be displayed. Alternatively, when a dangerous situation does exist ahead, the signal can contain information that a dangerous situation does in fact exist, and where, this information in the signal can be received by the communication system, and an appropriate collision avoidance action can be employed or otherwise initiated.

It will also be appreciated that it can be extremely inefficient for trains to repetitively be coming to full stops, only to resume operation once a potentially dangerous condition has been averted. Indeed, there may be situations where the potentially dangerous situation is cleared prior to any avoidance actions needing to be taken. As such, the track collision avoidance control system can further comprise an override made available to the train operator so that in certain situations the communication system and any avoidance actions initiated can be overridden. For example, the train operator may be in radio communication with one or more trains operating about the bi-directional track section discussed herein. In such a situation, the transmitter may be indicating the existence of a potentially dangerous condition, however, the operator may have information from another train operator or a central command that the track is clear. In such a case, the train operator can be permitted to override the communication system, such as by inputting an override code or engaging in some other type of override procedure.

As discussed above, the onboard disruptive control system can also be provided with an iridium link which can relay train information back to a control station. In this manner as technology advances and more locations are in possession of the type of positive train control discussed herein, the iridium link can be capable of communicating and implementing more advanced control systems. Additionally, an iridium link can provide the capability of inter-train communication as more and more trains are provided with the capabilities discussed herein.

It should also be understood that the transmitter can provide a direct link to the onboard disruptive control system for continuous monitoring regarding the train's distance from the warning indicator. Alternatively the transmitter can act like a beacon and ping the receiver periodically so that the onboard communication system 320 can update periodically in response to the transmitter signal. Pinging the signal can reduce the power consumption of the transmitter 220 as it would eliminate the need to continuously provide power as would be required to continuously broadcast the signal.

Additionally, it can be desirable to encrypt the signal broadcast by the transmitter. Encrypting the signal can ensure that the signal cannot be hi-jacked and manipulated by unauthorized users.

It should also be recognized that locations of potentially dangerous conditions can include, but are not limited to, track switching locations, sharp curves, vehicle crossings, bridges, etc. as will be recognized by those skilled in the art.

Figure 4:
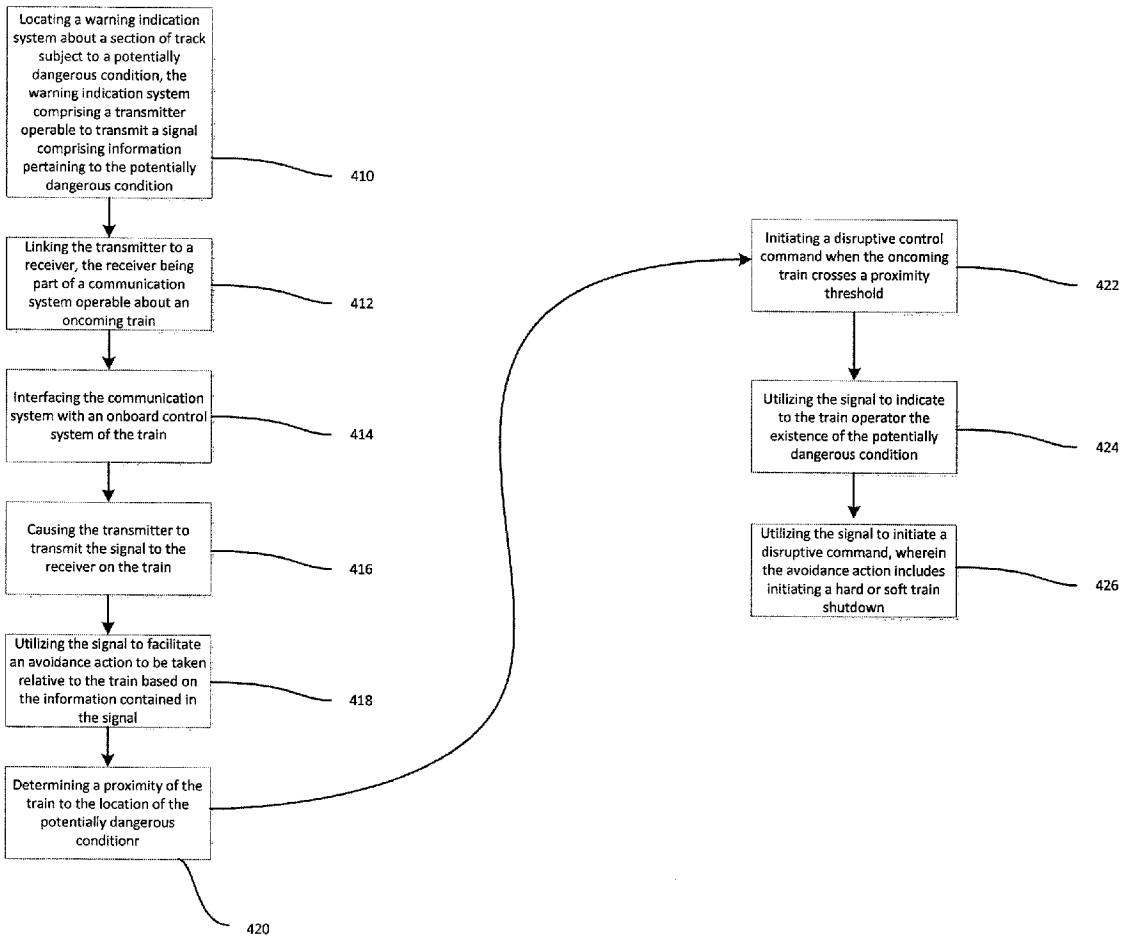
FIG. 4 illustrates a block diagram of an exemplary method for providing positive train control for avoiding potentially dangerous conditions about a section of track in accordance with an example.

Various methods of implementing the track collision avoidance control system of the present invention in order to avoid train collisions are contemplated herein. As depicted in FIG. 4, one method for providing positive train control for avoiding potentially dangerous conditions about a section of track can include locating a warning indication system proximate an area where a potentially dangerous condition can arise, the warning indication system having a transmitter operable to transmit a signal comprising information pertaining to the potentially dangerous 410; linking the transmitter to a receiver, the receiver being part of a communication system operable about an oncoming train 412; interfacing the communication system with an onboard control system of the train 414; causing the transmitter to transmit the signal to the receiver on the train 416; and utilizing the signal to facilitate an avoidance action to be taken relative to the train based on the information in the signal 418. Additional steps can include determining a proximity of the train to the location of the potentially dangerous condition 420; and initiating a disruptive control command when the oncoming train crosses the proximity threshold 422.

It will be appreciated that the method can include further steps in order to provide variation regarding how the method is performed depending on the types of avoidance actions which are most beneficial for a particular type of train. Variations can include utilizing the signal to indicate to the train operator the existence of the potentially dangerous condition; 424 utilizing the signal to initiate a disruptive command, wherein the avoidance action includes initiating a hard or soft train shutdown 426, i.e. applying the brakes or reducing the throttle or both. Such steps can be provided in conjunction with one another in any combination or selectively and independently from one another.

Alternative steps can also include variations regarding the placement of the transmitter with respect to the warning indication system to which it is connected, as well as variations between continuous or intermittent broadcasting of the signal. As discussed above, the transmitter can be caused to transmit a signal upon activation of the warning indicator of the warning indication system or upon independent recognition of the existence of a potentially dangerous situation. Also as discussed above the transmitter can transmit a signal containing various types of information.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention can be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics can be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A track collision avoidance control system operable with a train having an onboard control system, the track collision avoidance control system comprising:

a warning indication system located about a track section, the warning indication system comprising a transmitter operable to transmit a signal comprising at least information pertaining to a potentially dangerous condition; and a communication system supported onboard an oncoming train, the communication system comprising a receiver onboard the train operable to receive the signal, the communication system in electrical communication with an onboard control system of the train, wherein the communication system receives the signal from the transmitter, thereby facilitating an avoidance action to be taken relative to the train based on the information in the signal to avoid the potentially dangerous condition.

2. The track collision avoidance control system of claim 1, wherein the signal comprises information selected from the group consisting of a location of the transmitter, a location of the potentially dangerous situation, a status of the transmitter, and a combination of these.

3. The track collision avoidance control system of claim 1, wherein the warning indication system further comprises:

a warning indicator; and an actuator operable about the track to change a status of the warning indicator.

4. The track collision avoidance control system of claim 3, wherein the transmitter is in electrical communication with the warning indicator and operable to transmit a signal to the receiver comprising at least information pertaining to the warning indicator.

5. The track collision avoidance control system of claim 4, wherein the signal transmitted to the receiver by the transmitter comprises information corresponding to a status and a location of the warning indicator.

6. The track collision avoidance control system of claim 1, wherein the communication system comprises a global positioning system (GPS) transceiver and a processor operable to receive and process signals from the receiver and the GPS transceiver.

7. The track collision avoidance control system of claim 1, wherein the communication system operates to determine a proximity of the train to a location of the potentially dangerous situation.

8. The track collision avoidance control system of claim 1, wherein the communication system causes the onboard control system to indicate the existence of the potentially dangerous situation.

9. The track collision avoidance control system of claim 8, wherein the disruptive command is selected from the group consisting of a throttle reduction command, a braking command, and a combination of these.

10. The track collision avoidance control system of claim 1, wherein the collision avoidance action comprises an action taken by the train operator.

11. The track collision avoidance control system of claim 1, wherein the communication system initiates a disruptive command to be performed by the onboard control system.

12. The track collision avoidance control system of claim 11, wherein the disruptive command is automatically initiated by the communication system when the proximity of the train to a location of the potentially dangerous situation is within a proximity threshold.

13. The track collision avoidance control system of claim 1, further comprising a plurality of transmitters located about the track.

14. The track collision avoidance control system of claim 1, wherein the collision avoidance action comprises at least one of indicating to an operator of the train the status of the warning indicator, indicating a proximity of the train to the warning indicator, and indicating an operator action to be taken by the operator.

15. A track collision avoidance control system comprising:

a warning indication system comprising a transmitter operable to transmit a signal containing information pertaining to a potentially dangerous condition about a track section; and a communication system located on an oncoming train, the communication system comprising a receiver that receives the information, wherein the communication system selects from a predetermined set of commands regarding an avoidance action to be taken to avoid the potentially dangerous condition.

16. A method for providing positive train control for avoiding potentially dangerous conditions about a section of track, the method comprising:

locating a warning indication system about a section of track subject to a potentially dangerous condition, the warning indication system comprising a transmitter operable to transmit a signal comprising information pertaining to the potentially dangerous condition;

linking the transmitter to a receiver, the receiver being part of a communication system located onboard an oncoming train;

interfacing the communication system with an onboard control system of the train;

causing the transmitter to transmit the signal to the receiver on the train; and utilizing the signal to facilitate an avoidance action to be taken relative to the train based on the information in the signal to avoid the potentially dangerous condition.

17. The method of claim 16, further comprising determining a proximity of the train to a location of the potentially dangerous condition.

18. The method of claim 17, further comprising initiating a disruptive control command when the oncoming train crosses a proximity threshold.

19. The method of claim 16, wherein utilizing the signal comprises initiating a disruptive command, and wherein the avoidance action comprises automatically initiating a hard or soft train shut down.

20. The method of claim 16, further comprising integrating the transmitter into the logic circuitry of an existing warning indicator and actuator combination, wherein the transmitter is caused to transmit the signal upon activation of the warning indicator.

* * * * *